US005205165A

United States Patent [19]

Jardine et al.

[11] Patent Number: 5,205,165

[45] Date of Patent: Apr. 27, 1993

[54] METHOD FOR DETERMINING FLUID INFLUX OR LOSS IN DRILLING FROM FLOATING RIGS

[75] Inventors: Stuart I. Jardine; Dominic P. J. McCann, both of Paris, France

[73] Assignee: Schlumberger Technology Corporation, Houston, Tex.

[21] Appl. No.: 832,161

[22] Filed: Feb. 6, 1992

[30] Foreign Application Priority Data

Feb. 17, 1991 [EP] European ..... 91400302.5

[51] Int. Cl.[5] ..... E21B 21/08; G01V 9/02

[52] U.S. Cl. ..... 73/155; 166/250

[58] Field of Search ..... 73/155, 151; 166/250

[56] References Cited

U.S. PATENT DOCUMENTS 3,614,761 10/1971 Rohm et al. ..... 73/155
3,646,808 3/1972 Leonard .
3,729,986 9/1973 Leonard .
3,760,891 9/1973 Gadbois .
3,802,502 4/1974 Tanguy et al. .
3,813,935 6/1974 Tanguy et al. .
3,821,726 6/1974 Chang et al. .
3,841,152 10/1974 Guest .
3,910,110 10/1075 Jefferies et al. .
3,976,148 8/1976 Maus et al. ..... 73/155
4,282,939 8/1981 Maus et al. ..... 73/155
4,299,123 11/1981 Dowdy .
4,440,239 4/1984 Evans .
4,492,865 1/1985 Murphy et al. .
4,527,425 7/1985 Stockton .
4,553,429 11/1985 Evans et al. .
4,565,086 1/1986 Orr, Jr. .
4,606,415 8/1986 Gray, Jr. et al. .
4,610,161 9/1986 Gehrig et al. .
4,733,232 3/1988 Grosso .
4,733,233 3/1988 Grosso et al. .
4,840,061 6/1989 Peltier .
4,980,642 12/1990 Rodney .

OTHER PUBLICATIONS

SPE/IADC 21995 "Improved rig safety by rapid and automated kick detection" McCann, White, Marais, Rodt. 1991.

*Primary Examiner*—Hezron E. Williams
*Assistant Examiner*—George M. Dombroske
*Attorney, Agent, or Firm*—John J. Ryberg; Wayne Kanak

[57] ABSTRACT

A method of determining fluid influx or loss from a well being drilled from a floating vessel and using a drilling fluid, the method comprising monitoring the flow of fluid from the well to obtain a varying signal indicative of the variation in flow from the well, monitoring the heave motion of the vessel to obtain a varying signal indicative of said motion, using the signal indicative of the heave motion to calculate the expected variation in fluid flow from the well due to said motion, using said calculated flow to correct the varying flow signal to compensate for any flow component due to heave motion and monitoring the compensated signal for an indication of fluid influx or loss from the well.

14 Claims, 3 Drawing Sheets

METHOD FOR DETERMINING FLUID INFLUX OR LOSS IN DRILLING FROM FLOATING RIGS

BACKGROUND OF THE INVENTION

1. Field of the Invention

The present invention relates to a method for determining fluid influx or loss when drilling wells from a floating rig, for example a drill ship or a semi-submersible rig.

2. Description of the Related Art

In certain situations in the petroleum industry, oil bearing formations are to be found beneath the sea bed. Where the sea bed is up to 350 ft below the sea level, bottom supported drilling rigs such as jack-up rigs can be used. However, in deeper water it is not possible for the drilling rig to rest on the bottom and a floating platform must be used. Floating platforms such as drill ships or semi-submersible rigs can operate in much deeper water than bottom supported rigs but do suffer from problems in maintaining a steady positional relationship with the sea bed. While horizontal movements can be controlled to some degree by dynamic positioning systems and anchoring, vertical movement or "heave" due to wave action remains.

It is current practise to utilise a drilling fluid or mud in petroleum or geothermal well drilling. The mud is pumped into the drillstring at the surface and passes downwardly to the bit from where it is released into the borehole and returns to the surface in the annular space between the drillstring and borehole, carrying up cuttings from the bit back to the surface. The mud also serves other purposes such as the containment of formation fluids and support of the borehole itself. When drilling a well, there exists the danger of drilling into a formation containing abnormally high pressure fluids, especially gas, which may pass into the well displacing the mud. If this influx is not detected and controlled quickly enough, the high pressure fluid may flow freely into the well causing a blowout. Alternatively, some formations may allow fluid to flow from the well into the formation which can also be undesirable.

Fluid influx (or a "kick") or fluid loss (lost circulation) can be detected by comparing the flow rate of mud into the well with the flow rate of mud from the well, these two events being indicated by a surfeit or deficit of flow respectively. However, in floating rigs, heave motion effectively changes the volume of the flow path for mud flow to and from the well making the detection of kicks or lost circulation difficult in the short term.

A method and apparatus for detecting kicks and lost circulation is described in U.S. Pat. No. 3,760,891 in which the return mud flow is monitored and the values accumulated over overlapping periods of time. By comparing the flow from one period with that of a previous period and comparing with preselected values, the flow rate change is determined. However, this technique is relatively slow to determine anomalous flow situations.

SUMMARY OF THE INVENTION

It is an object of the present invention to provide a method which can be used to effect real-time correction of measured flow rates to compensate for rig heave motion.

In accordance with the present invention, there is provided a method of determining fluid influx or loss from a well being drilled from a floating vessel using a drilling fluid, the method comprising monitoring the flow of fluid from the well to obtain a varying signal indicative of the variation in flow from the well, monitoring the heave motion of the vessel to obtain a varying signal indicative of said motion, using the signal indicative of the heave motion to calculate the expected variation in fluid flow from the well due to said motion, using said calculated flow to correct the varying flow signal to compensate for any flow component due to heave motion and monitoring the compensated signal for an indication of fluid influx or loss from the well.

By monitoring the heave motion of the vessel separately from the flow movement, the observed flow can easily be corrected to remove any effects of heave motion so allowing faster correction and hence greater accuracy in anomalous flow detection. Other rig motion components such as roll which also affect the drilling fluid flow could also be compensated for in a similar manner. Preferably, the compensated signal is compared with the measured flow into the well. The difference between these signals can be used to raise alarms where necessary.

The flow measurement is typically obtained from a flow meter in the fluid output from the well and the heave motion is typically obtained from an encoder on a slip joint in the marine riser. Flow into the well can be calculated from the volume of mud pumped by the mud pumping system into the well.

To determine whether the flow from the well is anomalous, the compensated value is preferably compared with an upper and/or a lower threshold to determine fluid influx or loss respectively.

It is preferred that the calculations should be performed simultaneously with continuous measurements and can be on a time averaged basis if required.

BRIEF DESCRIPTION OF THE DRAWINGS

The invention will now be described, by way of example with reference to the accompanying drawings in which.

DESCRIPTION OF THE PREFERRED EMBODIMENT

Figure 1:
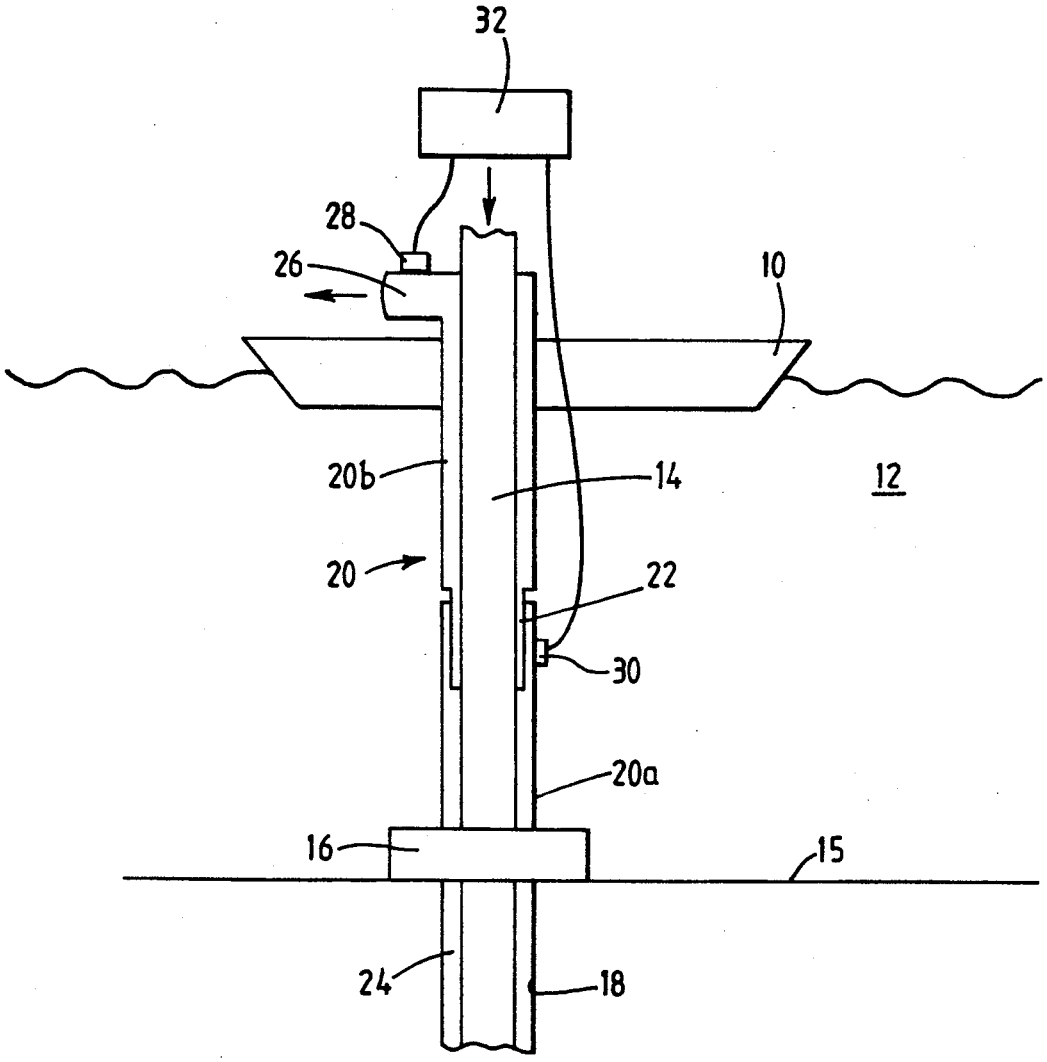
FIG. 1 is a representation of a floating drilling rig shown in schematic form.

Referring now to FIG. 1, there is shown therein a schematic view of a situation in which the present invention might find use. The rig shown therein has parts omitted for reasons of clarity and comprises a vessel hull 10 which is floating in the water 12. The vessel can be a drilling ship or semi-submersible rig or other floating vessel and can be maintained in position by appropriate means such as anchoring or dynamic positioning means (not shown). A drillstring 14 passes from the rig to the sea bed 15, through a BOP stack 16 into the borehole 18. The vessel 10 and BOP stack 16 are connected by means of a marine riser 20 comprising a lower section 20a, fixed to the BOP stack 16, and an upper section 20b fixed to the hull 10. The upper and lower sections 20a, 20b are connected by means of a telescopic joint or "slip joint" 22 to allow heave movement of the hull 10 without affecting the marine riser 20.

In use, drilling mud is pumped down the inside of the drillstring 14 to the bit (not shown) where it passes upwards to the surface through the annular space 24 between the drillstring 14 and the borehole 18. The mud passes from the borehole 18 to the vessel 10 through the marine riser 20 and returns to the circulating system (not shown) from an outflow 26.

The amount of mud pumped into the well can be determined from the constant displacement pumps used to circulate the mud. A flow meter 28 is provided on the outflow 26 to monitor the amount of mud flowing from the well and an encoder 30 is provided in the slip joint 22 to monitor the relative vertical position of the hull 10 from the sea bed 15. The output from the flow meter 28, encoder 30 and other monitoring devices is fed to a processor 32 for analysis.

In situations where the sea is calm, the hull 10 maintains a substantially constant vertical position with respect to the sea bed. Consequently, the value of the marine riser remains substantially constant and so in normal conditions the flow of mud into the well $Q_i$ is the same as the flow of mud out of the well $Q_o$. In cases of fluid influx, the amount of fluid in the well is increased and so can be detected as $Q_o$ will exceed $Q_i$. In cases of lost circulation the reverse is true, $Q_i$ exceeding $Q_o$.

Figure 2:
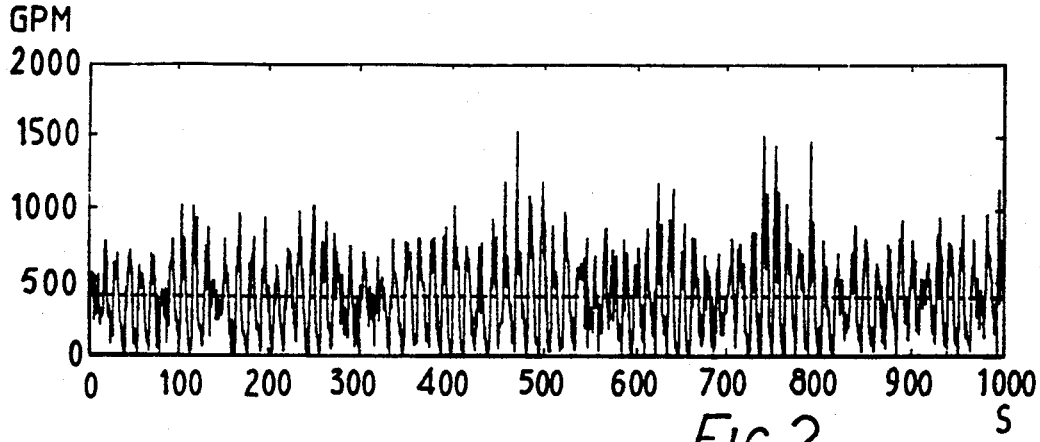
FIG. 2 shows an unprocessed plot of flow from the well (gallons per minute (GPM) vs. seconds (S))
Figure 3:
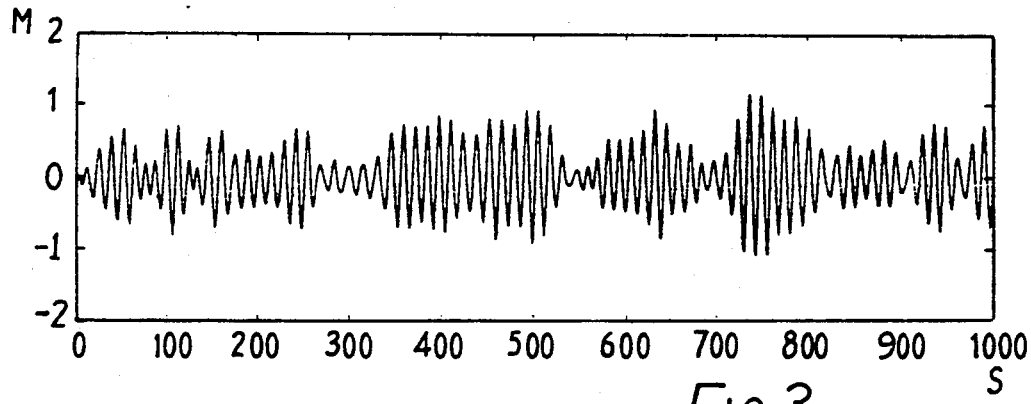
FIG. 3 shows an unprocessed plot for heave motion of the rig (relative vertical position in meters (m) vs. seconds (S))

However, when the sea is not calm, one effect of any wave motion will be to cause the relative vertical position of the hull to vary and this motion is known as "heave". A typical plot of heave motion of a rig is shown in FIG. 3. As will be apparent, a variation in the vertical position of the hull 10 will cause a variation in the length and consequently volume of the marine riser through the action of the slip joint. As $Q_i$ is substantially constant, $Q_o$ will be affected by the volume change due to heave and a typical plot of $Q_o$ with the effect of heave is shown in FIG. 2. In floating rigs, the $Q_i$ is typically 400 gallons/minute. However, the effect of heave is to cause $Q_o$ to vary between 0 and 1500 gallons/minute such that any influx or loss causing a change in $Q_o$ of 50–100 gallons/minute, which is a typical change which one would want to detect in the initial stages of such situations, would not be discernible.

Figure 4:
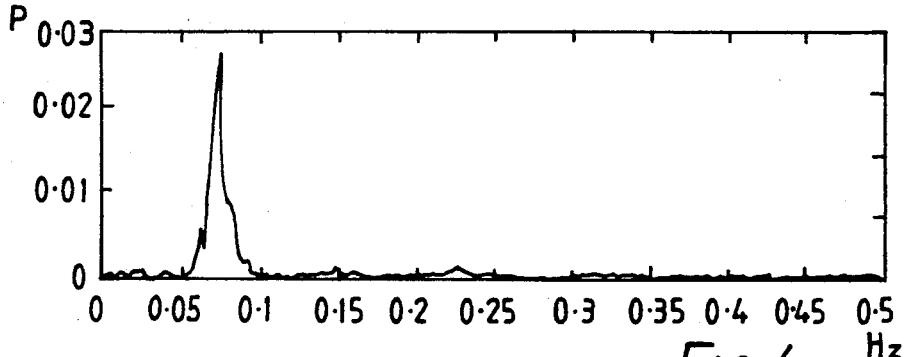
FIGS. 4 and 5 show spectral analyses of the signals from FIGS. 2 and 3 (power (P) vs. frequency (Hz)
Figure 5:
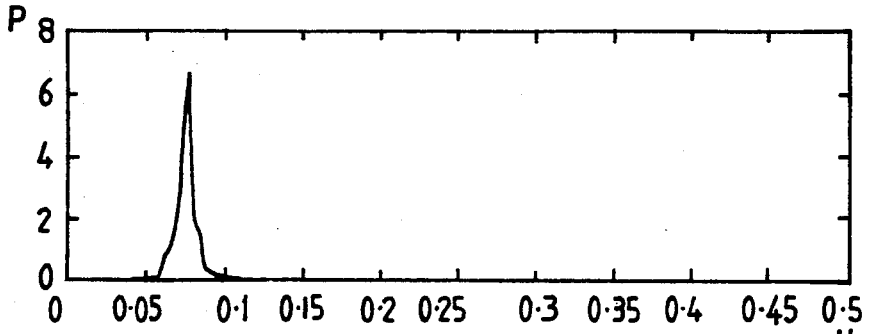
Figure 6:
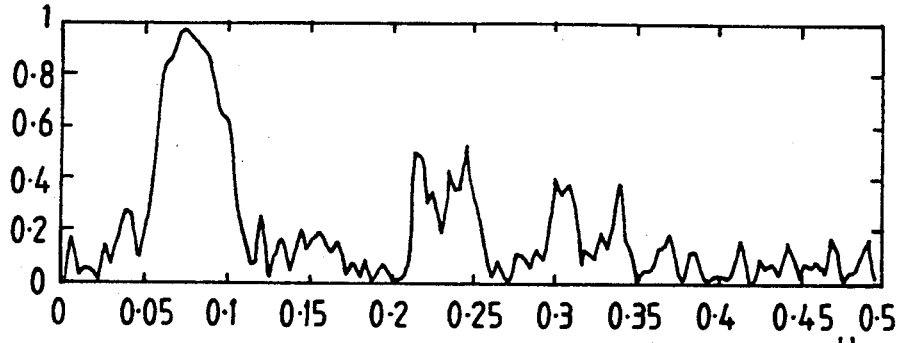
FIG. 6 shows a coherence plot obtained using the special data of FIGS. 4 and 5 (coherence vs. frequency (Hz)

Spectral analysis of the flow and heave signals of FIGS. 2 and 3 are shown in FIGS. 4 and 5 respectively and in both cases a dominant dynamic component is found at around 0.08 Hz which corresponds to the heave motion of the vessel. The two signals are found to be strongly coherent at this frequency as shown in FIG. 6 suggesting that most of the variation in $Q_o$ results from heave motion but is phase shifted relative thereto. The recognition of this fact makes it possible to determine the instantaneous effect of heave on $Q_o$ if the heave motion is known. Heave motion can be determined from the slip joint encoder and $Q_i$ and $Q_o$ from flow meters. From these measurements it would be possible to obtain an expected value for $Q_o$ from $Q_i$ and heave data and this value $Q_o$(exp) can be compared when the actual value found when observed $Q_o$ is corrected for heave $Q_o$(cor). The difference $Q_o$(cor)$-Q_o$(exp) will show whether more or less mud is flowing from the well than should be if there were no anomalous conditions.

One embodiment of the present invention utilises adaptive filtering techniques to obtain a filter which models the relationship between the time differentiated heave channel signal as the filter input and the flow-out signal as the filter output. Suitable algorithms are available in the literature, for example the "least mean squares (LMS)" method gives adequate performance in this application. The adaptive filter recursively provides estimates of the impulse response vector "h(t)" which forms the modelled relation of the slip joint signal to the dynamic component of the flow signal. The adaptive nature of the filter ensures that the model changes slowly with time in response to changing wave conditions and mud flow velocities. At any time "t", an estimate of the expected dynamic flow component can be obtained by convolving h(t) with the current segment of heave data to obtain the current predicted flow as the output from the filter. This predicted flow variation due to heave motion can then be subtracted from the measured flow, either on an instantaneous or time averaged basis, to produce the corrected flow measurements.

Adaptive filtering techniques as described above have the function of adjusting the amplitudes and/or phases of the input data to match those of a "training signal" which in this case is provided by sections of flow data having dynamic components dominated by the rig motion. From FIGS. 2 and 3 it is evident that one narrow-band signal dominates both the heave and the flow data. A good estimate of the required model with which to obtain the dynamic flow estimate can therefore be obtained by estimating the required amplitude and phase processing of this frequency component in the heave measurement. This has the advantage that the necessary processing can be economically applied in the time-domain. A detailed implementation of this processing technique, is described as follows:

(i) The phase lead between the heave measurement and the flow output is estimated by cross-correlating segments of the heave and flow data. This may be achieved using direct correlation of the sampled time-domain signals:

$$r_{xy}(p) = \frac{1}{(2L+1)} \sum_{n=0}^{L} x(n) \cdot y(n+p)$$

where $r_{xy}$ (p)=correlation function

L=number of samples

The phase difference between the signals may then be determined by detecting the index of the local maximum in $r_{xy}$.

(ii) To effect amplitude calibration, the amplitude of the derivative of the heave signal is normalised to the standard derivation (square-root of the variance) of the flow signal. The amplitude calibration may then be updated with corrections derived from the amplitudes of predicted and measured flow readings.

(iii) The amplitude and phase correction is applied to the heave measurement to give a predicted flow reading due to rig motion. This value may be advantageously averaged over an integer number of heave periods and subtracted from the averaged flow measurements made during the same heave period. The compensated flow measurement then more closely represents the true fluid flow from the well without artifacts due to rig motion. The amplitude and phase corrections may be updated at frequent intervals in order to adaptively optimise the modelled flow data.

(iv) Using the correct flow measurement, further processing may be applied to detect anomalous flow conditions. In general it is the difference between the flow into and out of the well which is measured. An improved difference indication is achieved using these techniques due to the improved accuracy of the flow-out measurement. This difference signal is typically applied to a trend detection algorithm to give rapid detection of abnormal flow changes.

Figure 7:
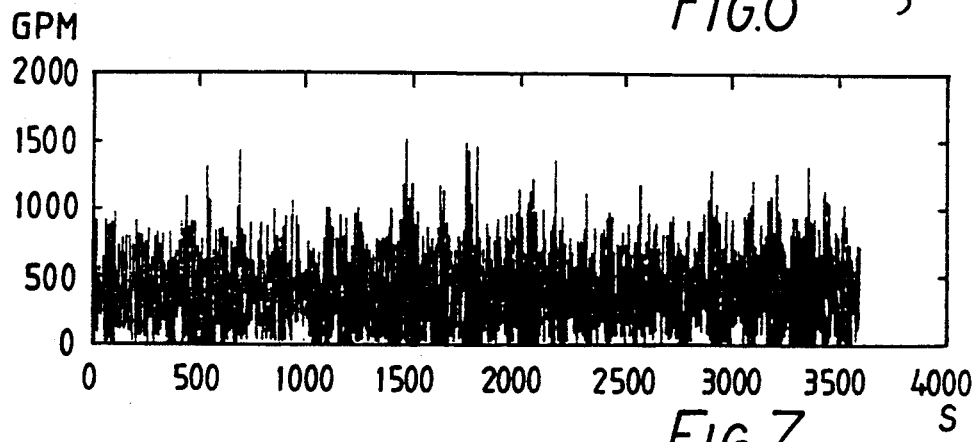
FIG. 7 shows a plot of a constant flow rate with heave motion superimposed thereon.
Figure 8:
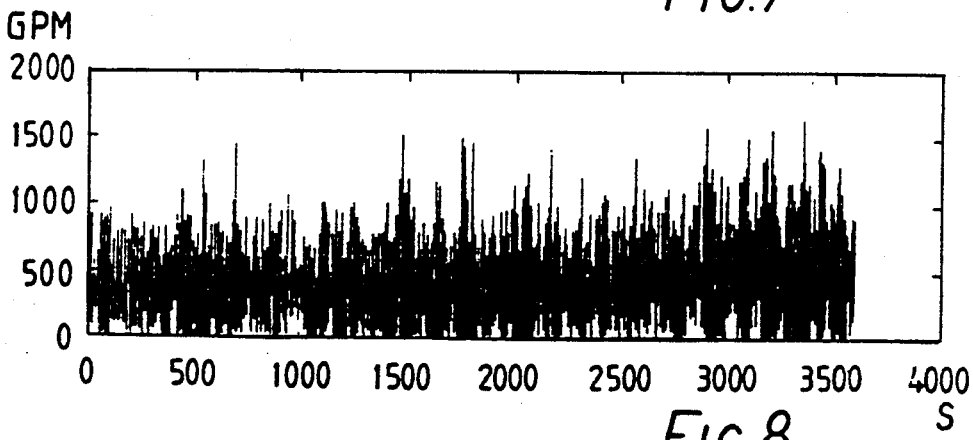
FIG. 8 shows a plot of an increasing flow with heave motion superimposed thereon.
Figure 9:
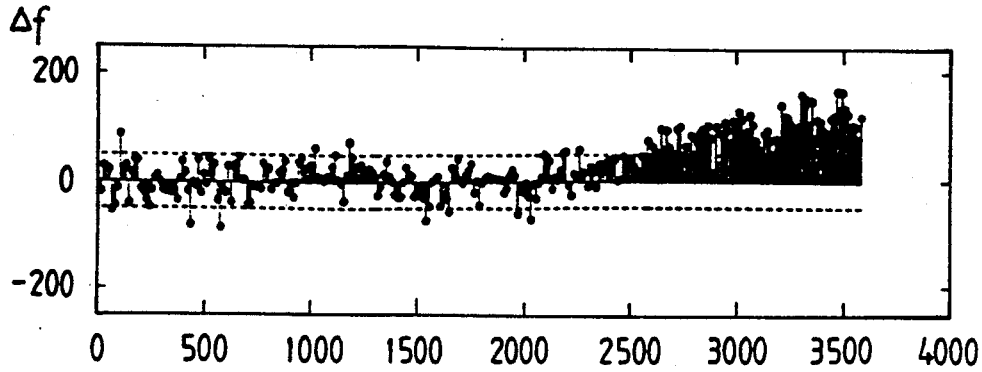
FIG. 9 shows a plot of differential flow derived from FIG. 8 and compensated for heave motion.

An example of the flow out signal obtained during nominally constant flow into the well of 400 GPM, but during conditions of excessive heave, is shown in FIG. 7 over a time interval of 1 hour. In FIG. 8, the difference between flow into and out of the well is ramped from 0 to 100 gallons/minute during the time interval 2000 to 3000 seconds. The processing techniques described above are applied to the data shown in FIGS. 7 and 8 to yield the differential flow signal shown in FIG. 9. The influx is readily identified in the processed signal when the flow rate exceeds the input flow by about 50 GPM (represented by a dotted line in FIG. 9.).

For Influx/Loss detection it is necessary to discriminate when $Q_o(cor)-Q_o(exp)$ is non zero. When the flow correction technique described above is applied to typical field data it gives improved estimate of delta flow and variations of around 50 GPM are readily discernible. The detection of smaller influxes/losses than this can can be achieved by applying statistical processing, e.g. simple averaging or trend analysis, to the improved delta flow data and can be used to give automatic detection of this influx/loss.

We claim:-

1. A method of determining fluid influx or loss from a well being drilled from a floating vessel and using a drill string through which a drilling fluid is circulated such that said fluid flows into the well via the drill string and flows out of the well at the surface, the method comprising:

(a) monitoring the flow of fluid from the well to obtain a varying flow signal indicative of the variation in flow from the well, (b) monitoring any heave motion of the vessel to obtain a varying heave motion signal indicative of said motion, (c) using the varying heave motion signal and the variance in the flow from the well over a period of time to calculate an expected variation in said fluid flow from the well due to said motion, (d) using the calculated expected variation in flow to correct the varying flow signal to compensate for any varying flow component due to said heave motion thereby generating a compensated flow signal; and (e) monitoring the compensated flow signal for an indication of fluid influx or loss from the well.

2. A method as claimed in claim 1, further comprising the step of comparing the compensated flow signal with a signal indicative of the flow of fluid into the well to obtain a flow difference measurement.

3. A method as claimed in claim 2, further comprising the step of comparing the flow difference measurement with an upper and/or a lower threshold to determine fluid influx or loss respectively.

4. A method as claimed in claim 1, wherein said varying heave motion signal is obtained from a slip joint in a marine riser connecting the vessel to the well.

5. A method as claimed in claim 1, wherein the varying flow signal is obtained from a flow meter in a fluid output from the well.

6. A method as claimed in claim 1, wherein the indication of fluid influx or loss is obtained by comparing the expected flow and an observed flow.

7. A method as claimed in claim 1 wherein the step of calculating an expected variation in said fluid flow is performed concurrently with the monitoring steps (a) and (b).

8. A method as claimed in claim 7, wherein the calculation of an expected variation in said fluid flow is modified to take into account changing conditions of operation.

9. A method as claimed in claim 1, wherein the step of calculating an expected variation in said fluid flow is performed on a time averaged basis.

10. A method as claimed in claim 1, wherein the step of calculating an expected variation in said fluid flow includes the step of determining the phase difference between heave motion and flow signals having substantially the same phase.

11. A method of determining fluid influx or loss from a well being drilled from a floating vessel and using a drill string through which a drilling fluid is circulated such that said fluid flows into the well via the drill string and flows out of the well at the surface, the method comprising:

(a) monitoring the flow of fluid from the well to obtain a varying signal indicative of the variation in flow from the well, (b) monitoring any heave motion of the vessel over a given period of time to obtain a time differentiated heave motion signal indicative of said motion, (c) using an adaptive filtering technique to obtain an adaptive filter which models the relationship between said time differentiated heave motion signal and said signal indicative of the variation in flow from the well, (d) determining with said adaptive filter an expected variation in said fluid flow using a current value of said time differentiated heave motion signal as an input to said adaptive filter, said expected variation in said fluid flow being the output of said adaptive filter, (e) using the calculated expected variation in flow to correct the varying flow signal to compensate for any varying flow component due to said heave motion thereby generating a compensated flow signal; and (f) monitoring the compensated flow signal for an indication of fluid influx or loss from the well.

12. A method as claimed in claim 11, wherein the step of generating a compensated flow signal is on an instantaneous basis.

13. A method as claimed in claim 11, wherein the step of generating a compensated flow signal is on a time averaged basis.

14. A method as claimed in claim 11, wherein said adaptive filter recursively provides estimates of an impulse response vector comprising the modeled relationship between said time differentiated heave motion signal and said signal indicative of the variation in flow from the well, an estimate of the expected variation in flow being obtained by convolving said impulse vector with a current value of said time differentiated heave motion signal.

* * * * *